US008066278B2

(12) United States Patent
Sanada et al.

(10) Patent No.: US 8,066,278 B2
(45) Date of Patent: Nov. 29, 2011

(54) PRINTER

(75) Inventors: Tsuyoshi Sanada, Singapore (SG); Kiyoshi Morino, Shizuoka (JP); Tsutomu Fujiwara, Singapore (SG); Toshiharu Sekino, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 98 days.

(21) Appl. No.: 12/556,902

(22) Filed: Sep. 10, 2009

(65) Prior Publication Data

US 2010/0078869 A1 Apr. 1, 2010

(30) Foreign Application Priority Data

Sep. 29, 2008 (JP) ..... 2008-250820

(51) Int. Cl.
*B65H 29/00* (2006.01)
*B65H 5/00* (2006.01)

(52) U.S. Cl. ..... 271/225; 271/902; 271/184; 271/3.01; 271/3.14; 271/303

(58) Field of Classification Search ..... 271/3.01, 271/3.14, 3.18, 225, 184, 902, 303; 902/14, 902/15, 17, 18, 9, 13
See application file for complete search history.

(56) References Cited

U.S. PATENT DOCUMENTS

| | | | | | |
|---|---|---|---|---|---|
| 4,747,493 | A * | 5/1988 | Nakanishi | 209/534 |
| 4,822,018 | A * | 4/1989 | Hain | 271/3.2 |
| 5,303,017 | A * | 4/1994 | Smith | 399/403 |
| 5,330,316 | A * | 7/1994 | Buckman et al. | 414/790.2 |
| 5,951,004 | A * | 9/1999 | Hadfy-Kovacs et al. | 271/184 |
| 6,073,837 | A * | 6/2000 | Milne | 235/379 |
| 6,273,413 | B1 * | 8/2001 | Graef | 271/3.14 |
| 7,726,648 | B2 * | 6/2010 | Tamura et al. | 271/176 |
| 2010/0059922 | A1 | 3/2010 | Sekino | |

FOREIGN PATENT DOCUMENTS

| | | |
|---|---|---|
| JP | 10250914 | 9/1998 |
| JP | 2007156406 | 6/2007 |

* cited by examiner

*Primary Examiner* — Stefanos Karmis
*Assistant Examiner* — Luis A Gonzalez
(74) *Attorney, Agent, or Firm* — Turocy & Watson, LLP

(57) ABSTRACT

In the state that a preceding sheet awaits at an awaiting position, a pair of conveying rollers are separated from each other, and the front end of a subsequent sheet sent out from a main conveying path passes the gap between the pair of conveying rollers. Based on a configuration that the distance from the trailing end of the subsequent sheet in the conveying direction to the pair of conveying rollers becomes equal to that from the front end of the preceding sheet to the pair of conveying rollers, the preceding sheet and subsequent sheet are sandwiched by the pair of conveying rollers so as to be conveyed in a first direction, thereby making the sheets into a state that the sheets are put on each other. Thereafter, the sheets are conveyed in a second direction by the pair of conveying rollers, so as to be discharged into discharging unit.

11 Claims, 7 Drawing Sheets

PRINTER

CROSS-REFERENCE TO RELATED APPLICATION

This application is based upon and claims the benefit of priority from the prior Japanese Patent Application No. 2008-250820, filed Sep. 29, 2008, the entire contents of which are incorporated herein by reference.

TECHNICAL FIELD

The present invention relates to a printer mounted in, for example, an automatic teller machine, in particular, a mechanism for discharging sheets on which transaction information is printed.

BACKGROUND

According to printers of this type, a sheet is conveyed along their conveying path, and transaction information is printed on this sheet in their printing unit. This information-printed sheet is discharged into their discharging unit, and then the sheet discharged in the discharging unit is received by a customer.

Incidentally, a plurality of sheets are continuously supplied for printing and then discharged into the discharging unit in some cases. In the cases, the sheets are discharged into the discharging unit in the state that the sheets are put onto each other in order for a customer to receive the sheets easily (see, for example, Jpn. Pat. Appln. KOKAI Publication No. 2007-156406).

However, when the sizes of the sheets put onto each other are different from each other in the prior art, there remains a problem that a customer does not receive the sheets easily since the sheets are discharged into the discharging unit in the state that the discharging side ends thereof are uneven or irregular.

SUMMARY

An aspect of the present invention has been made paying attention to the above-mentioned situations. An object thereof is to provide a printer capable of discharging sheets into a stack form in the state that the discharging side ends thereof are made even, even when the sizes of sheets are different from each other.

According to an aspect of the present invention, there is provided a printer comprising: a printing device which prints information on a first sheet conveyed along a main conveying path, and a second sheet conveyed subsequently to the first sheet; a conveying device arranged on the conveying-out side of the main conveying path, and having a pair of conveying rollers which can be freely contacted each other and separated from each other, which sandwich the front end side of the first sheet sent out from the main conveying path to convey the first sheet in a first direction, and which convey, after the trailing end side thereof passes the main conveying path, the first sheet into a second direction reverse to the first direction in the state that the trailing end side is directed ahead, so as to cause the first sheet to await at an awaiting position; a controlling device which controls in such a manner that the pair of conveying rollers are separated from each other to permit the front end side of the second sheet sent out from the main conveying path to be introduced into a gap between the conveying rollers, and based on a configuration that the distance from the trailing end of the second sheet in the conveying direction to the pair of conveying rollers becomes equal to the distance from the front end of the first sheet caused to await at the awaiting position to the pair of conveying rollers, the first and second sheets are sandwiched by the pair of conveying rollers so as to be conveyed in the first direction and be put onto each other, and subsequently the first and second sheets are conveyed to be sent out in the second direction; and a discharging unit which discharges the first and second sheets sent out in the state that the sheets are put onto each other.

According to the present invention, even when the sizes of sheets are different from each other, the sheets can be discharged into a stack form in the state that the discharging side ends thereof are made even. Thus, the sheets are easily received.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Hereinafter, an embodiment of the present invention will be described in detail with reference to the drawings.

Figure 1:
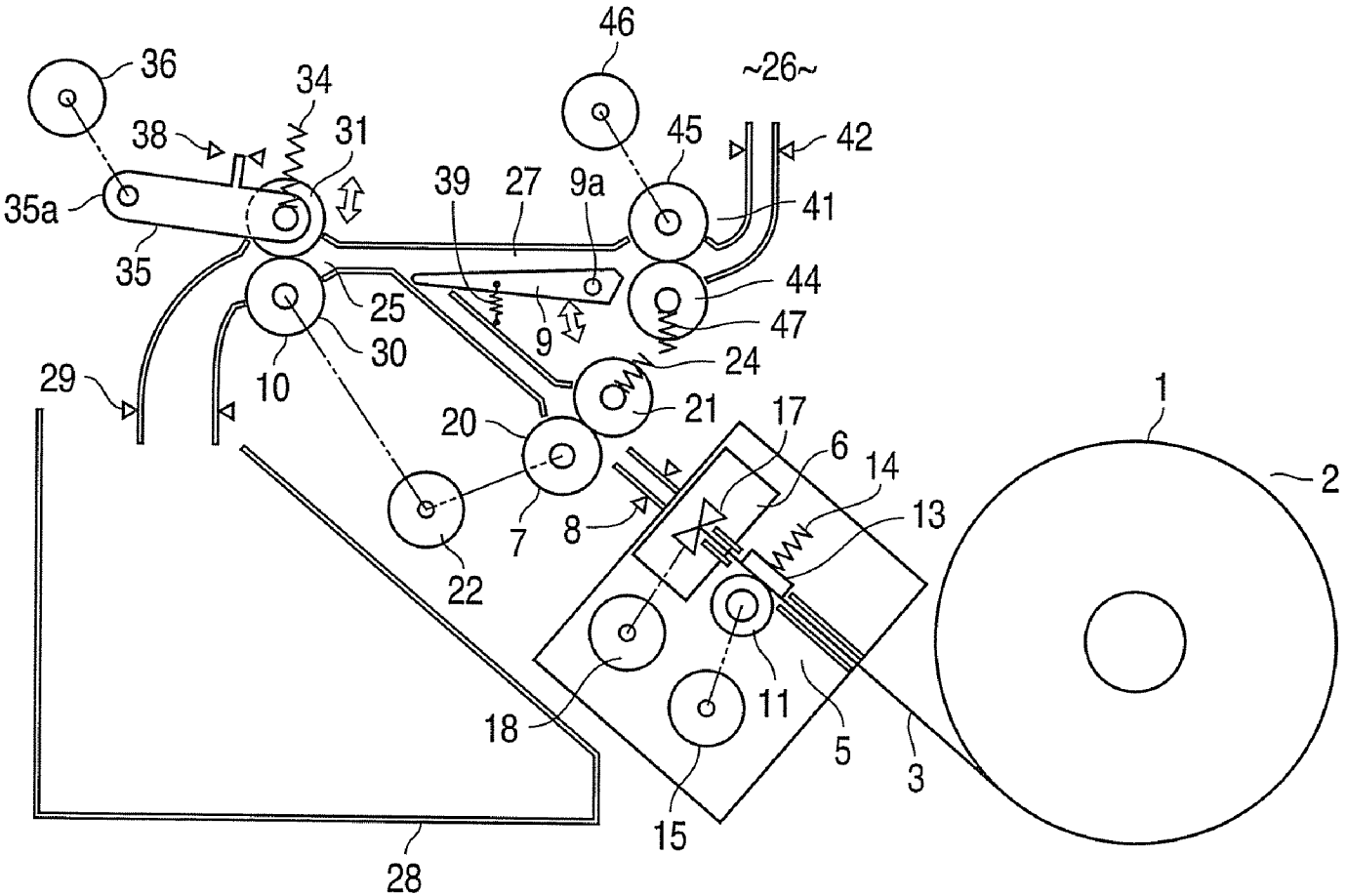
FIG. 1 is a structural view schematically illustrating a printer which is an embodiment of the present invention.

FIG. 1 is a structural view illustrating a printer which is the embodiment of the invention and is mounted in an automatic teller machine.

In FIG. 1, reference numeral 1 represents a roll paper fitted to a roll paper fitting unit 2, and the front end of this roll paper 1 may be pulled out from the roll paper fitting unit 2 and conveyed along a main conveying path 3. In the main conveying path 3, along the conveying direction, a printing unit 5 as a printing device, a cutter unit 6, a sending-out detecting sensor 8, and a first conveying roller unit 7 are successively arranged.

The printing unit 5 is provided with a platen 11 and a thermal head 13 arranged to be opposed to each other across the main conveying path 3. The thermal head 13 is elastically urged toward the platen 11 by effect of a head spring 14. A platen driving motor 15 is connected to the platen 11.

The sending-out detecting sensor 8 is formed to detect the front end of the roll paper 1 to be sent out, and further detect the trailing end of the roll paper, which is to be obtained by cutting with the cutter unit 6. The cutter unit 6 has a cutter 17 and a cutter driving motor 18 for driving this cutter 17.

The first conveying roller unit 7 conveys the roll paper 1 while sandwiching the paper 1 and includes a first driving roller 20 and a first pinch roller 21 arranged to be opposed to each other across the main conveying path 3. The first driving roller 20 is rotated forward and backward by means of a driving roller driving motor 22. The pinch roller 21 is elastically urged toward the first driving roller 20 by effect of a roller spring 24.

A collection conveying path 25 for guiding the cut roll paper 1 into a collecting shed 28, and a discharging conveying path 27 for guiding the roll paper 1 into a discharging unit 26 are connected to the discharging side of the main conveying path 3. The collection conveying path 25 and the discharging conveying path 27 are connected to each other, and the main conveying path 3 is opened and closed on the discharging side thereof through a flapper 9. The flapper 9 is supported on one of two end sides thereof by a supporting point 9*a*, so as to be freely rotated. The flapper 9 is urged downward on the other side by effect of a flapper spring 39, so as to be rotated. As a result, the flapper 9 closes the main conveying path 3 on the discharging side thereof.

In the collection conveying path 25, a second conveying roller unit 10 as a conveying device, and a collection detecting sensor 29 in an optical manner are arranged. The second conveying roller unit 10 conveys a sheet while sandwiching the sheet and includes a second driving roller 30 and a second pinch roller 31 arranged to be opposed to each other across the collection conveying path 25. The second driving roller 30 is driven to be rotated forward and backward by the driving roller driving motor 22.

The second pinch roller 31 is set up to a tip region of a roller arm 35 so as to be freely rotated. The roller arm 35 is rotated upward and downward around a supporting point 35*a* as a center by forward and backward rotations of an arm driving motor 36. The pinch roller 31 is elastically urged toward the second driving roller 30 by effect of a roller spring 34. An arm up-and-down motion detecting sensor 38 for optically detecting the up-and-down motion of the roller arm 35 is arranged over the roller arm 35.

In the discharging conveying path 27, a third conveying roller unit 41, and a discharge detecting sensor 42 in an optical manner are arranged. The third conveying roller unit 41 conveys a sheet while sandwiching the sheet and includes a third driving roller 45 and a third pinch roller 44 arranged to be opposed to each other across the discharging conveying path 27. The third driving roller 45 is rotated forward and backward by means of a driving roller driving motor 46. The pinch roller 44 is elastically urged toward the third driving roller 45 by effect of a roller spring 47.

The distance between the first conveying roller unit 7 and the second conveying roller unit 10 and that between the second conveying roller unit 10 and the third conveying roller unit 41 are each made shorter than the length of sheets of a minimum size. Thus, the minimum size sheets can be conveyed.

Figure 2:
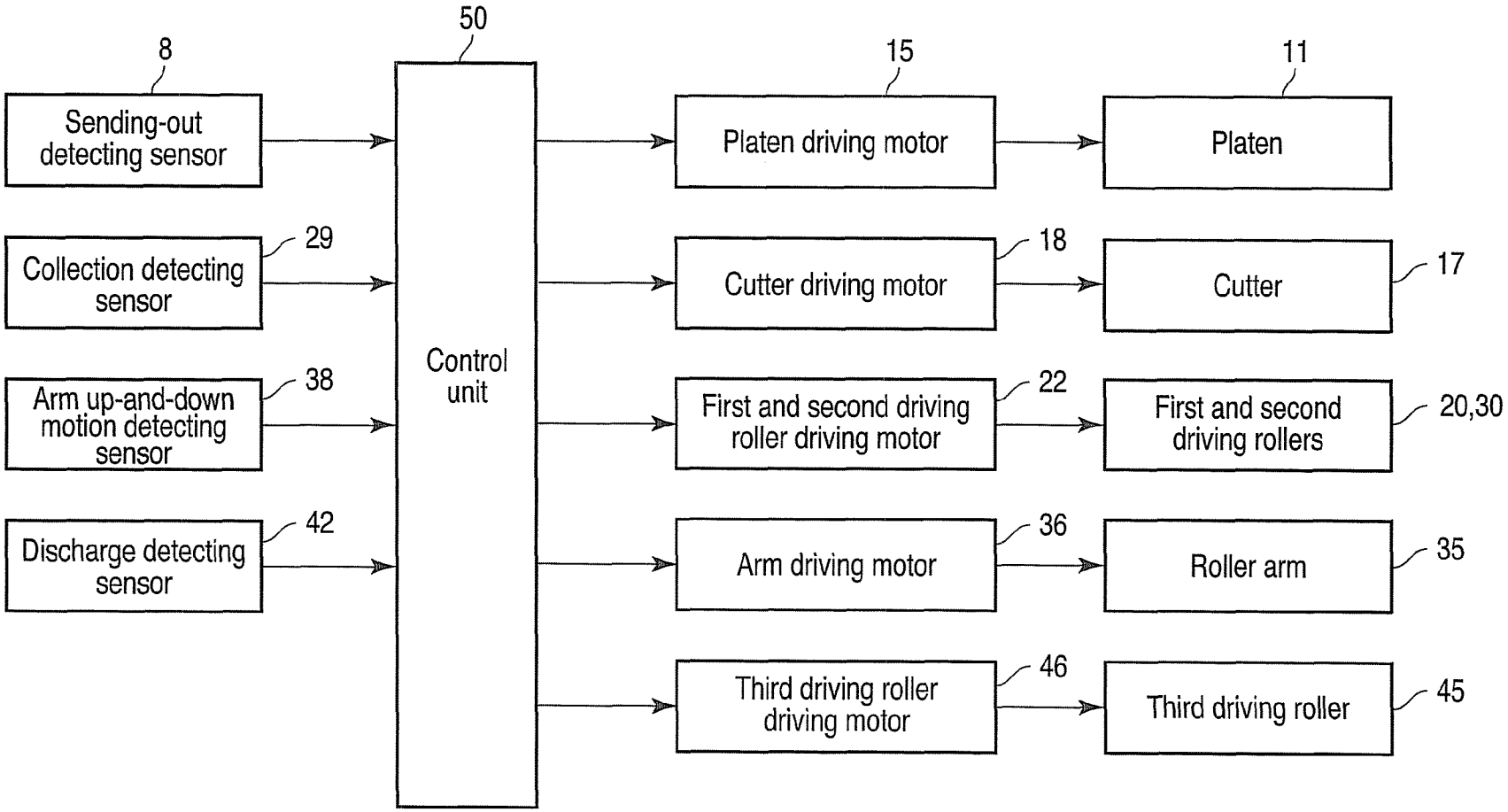
FIG. 2 is a block chart showing a driving control system of the printer shown in FIG. 1.

FIG. 2 is a block chart showing a driving control system of the printer.

The sending-out detecting sensor 8, the collection detecting sensor 29, the arm up-and-down motion detecting sensor 38, and the discharge detecting sensor 42 are connected to a control unit 50 as a control device through a detection signal circuit. The platen driving motor 15, the cutter driving motor 18, the motor 22 for driving the first and second driving rollers 20 and 30, the arm driving motor 36, and the motor 46 for driving the third driving roller 45 are connected to the control unit 50 through a control circuit. The control unit 50 controls the platen 11, the cutter 17, the first and second driving rollers 20 and 30, the roller arm 35, and the third driving roller 45 based on detection signals.

Next, the operation of the printer having the above-mentioned structure will be described with reference to FIGS. 3 to 11.

Figure 3:
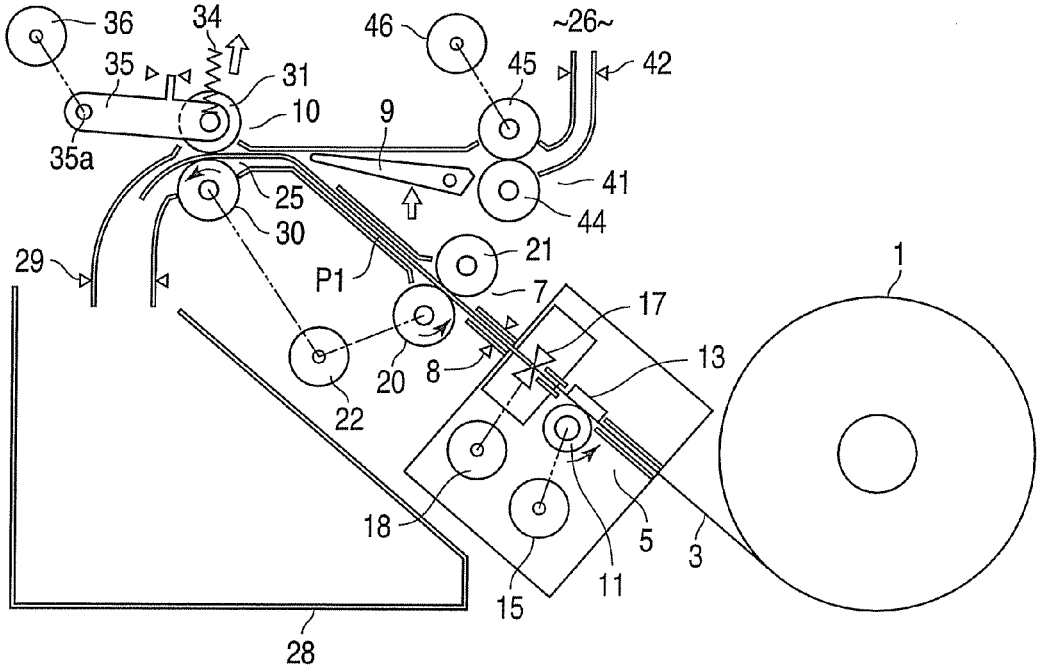
FIG. 3 is a view illustrating a state that a preceding sheet on which a print is made by a printing unit in FIG. 1 is conveyed in a direction reverse to the direction in which the sheet is to be discharged.

First, the platen driving motor 15 is driven from the state that the front end side of the roll paper 1 is sandwiched by the platen 11 and the thermal head 13. According to this driving, the roll paper 1 is conveyed while sandwiched by the platen 1 and the thermal head 13. Heat is then generated from the thermal head 13 to print transaction information on the roll paper 1. As illustrated in FIG. 3, the roll paper 1, on which the information is printed, is conveyed while sandwiched by the first driving roller 20 and the first pinch roller 21. By the front end thereof, the flapper 9 is pushed and raised up. In this state, the roll paper 1 passes the flapper 9. Thereafter, the roll paper 1 is sent into the collection conveying path 25 to pass the gap between the second driving roller 30 and the second pinch roller 31 so as to be conveyed.

Figure 4:
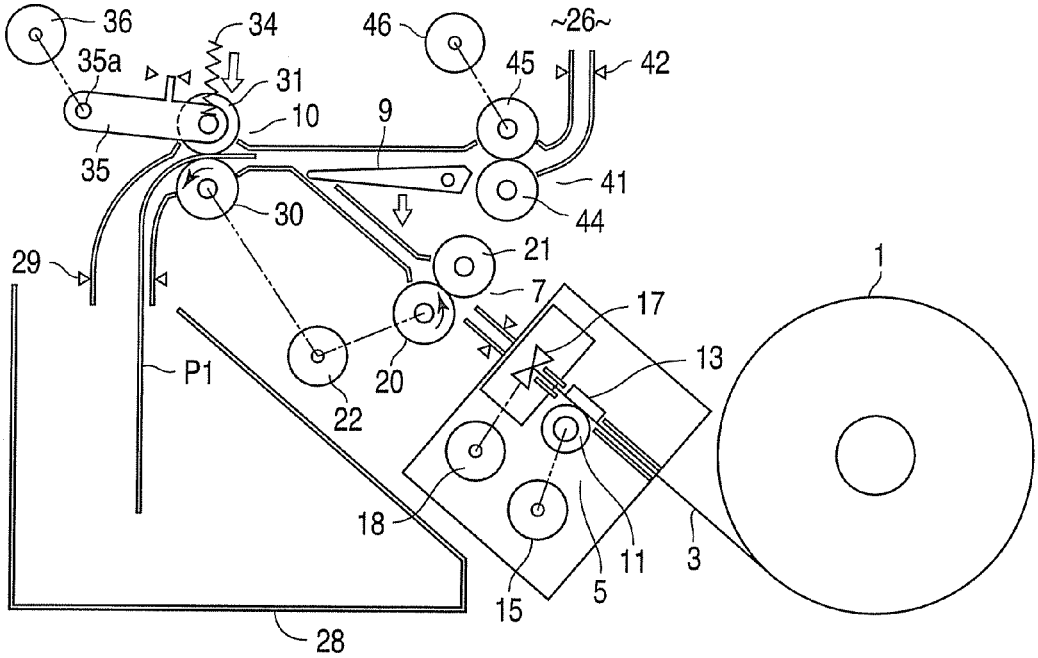
FIG. 4 is a view illustrating a state that the preceding sheet in FIG. 3 is further conveyed in the reverse-to-sheet-discharge direction and then stopped.

At this time, the second pinch roller 31 is separated upward from the second driving roller 30. When the roll paper 1 is conveyed by a predetermined distance, the cutter 17 is operated to cut the paper 1. In this way, a preceding sheet P1 (first sheet) is prepared. When the trailing end of this preceding sheet P1 in the conveying direction is detected by the sending-out detecting sensor 8, the arm driving motor 36 is rotated forward so that the roller arm 35 is rotated downward around the supporting point 35*a* as a center. Accordingly, the second pinch roller 31 pushes the preceding sheet P1 onto the second driving roller 30. In this state, the second driving roller 30 is reversely rotated so that the preceding sheet P1 is conveyed in a direction reverse to the direction in which the sheet is to be discharged (i.e., in a reverse-to-sheet-discharge direction which is a first direction) by a predetermined distance while the sheet P1 is sandwiched. As illustrated in FIG. 4, the trailing end of the sheet P1 in the conveying direction passes the front end of the flapper 9. Immediately, the preceding sheet P1 is stopped.

Figure 5:
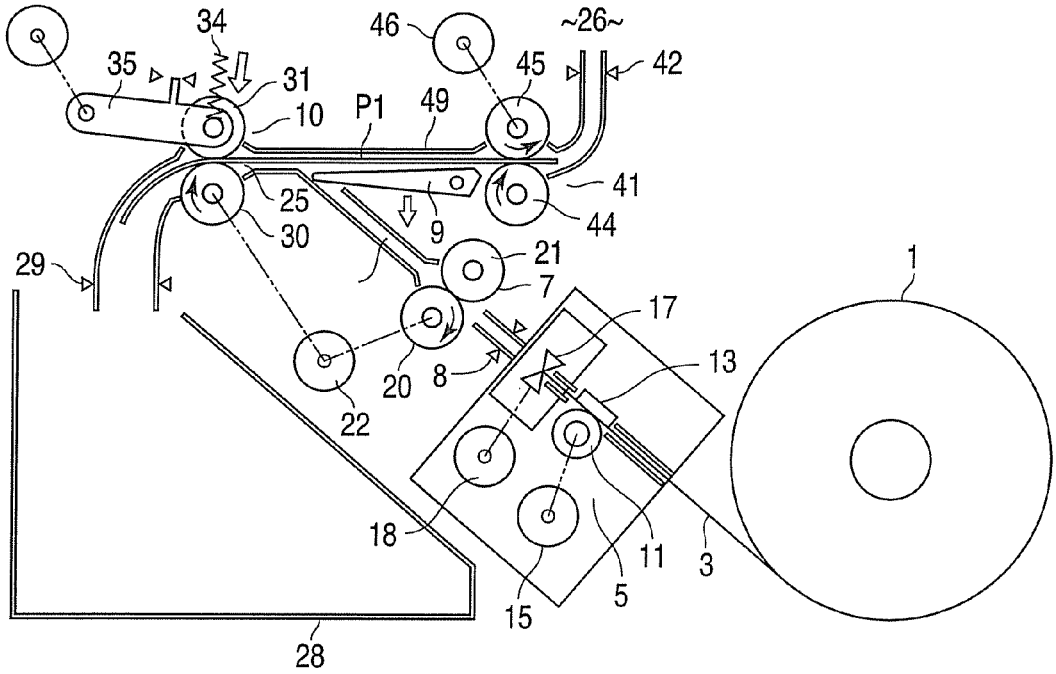
FIG. 5 is a view illustrating a state that the preceding sheet in FIG. 4 awaits at an awaiting position after the sheet is conveyed in the sheet-discharging direction by a predetermined distance.

At this time, the front end of the preceding sheet P1 in the conveying direction enters the inside of the collecting shed 28. As illustrated in FIG. 5, from this state, the second driving roller 30 and the third driving roller 45 are rotated in a forward direction (regular direction). In a case where only the sheet P1 is discharged alone, the sheet P1 is conveyed, as it is, in a sheet-discharging direction (second direction) in the state that the trailing end of the sheet P1 is directed ahead. In this way, the preceding sheet P1 is discharged into the discharging unit 26.

Figure 6:
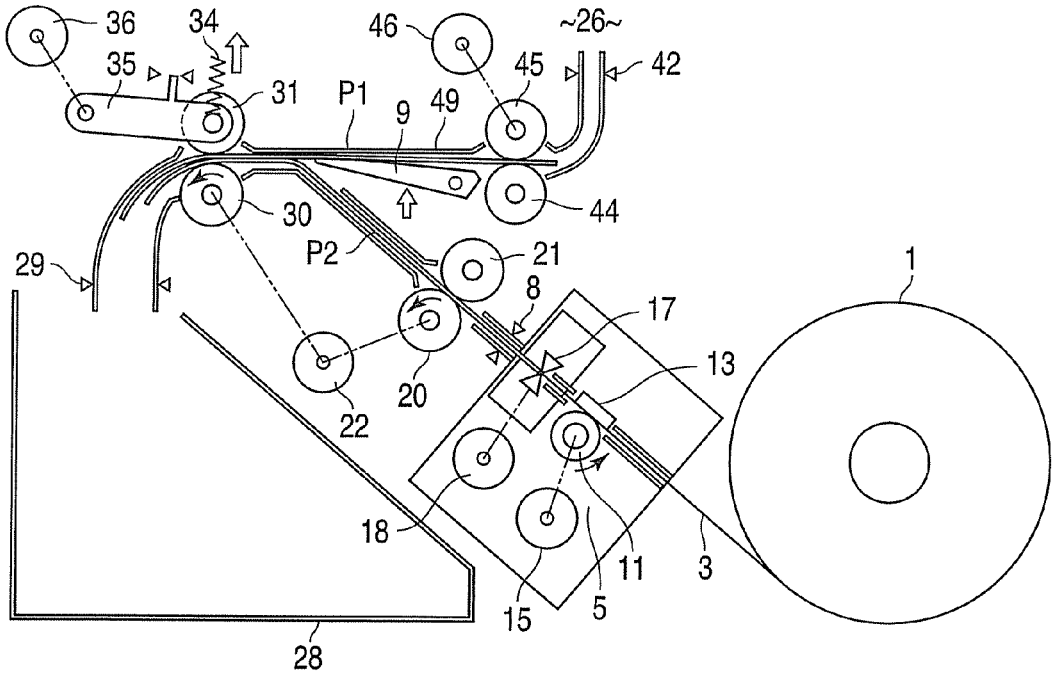
FIG. 6 is a view illustrating a state that a subsequent sheet is conveyed in the reverse-to-sheet-discharge direction while the preceding sheet awaits at the awaiting position.

In a case where a subsequent sheet (second sheet) P2 is sent subsequently to the preceding sheet P1 as illustrated in FIG. 6, the preceding sheet P1 is caused to await at an awaiting position 49, that is, at a position where the front end of the preceding sheet P1 passes the third driving roller 45.

As illustrated in FIG. 6, in the similar manner as in the case of the preceding sheet P1, the subsequent sheet P2 is conveyed by the rotation of the first driving roller 20. At this time, the second pinch roller 31 is in the state that the roller 31 is separated upward from the second driving roller 30. The front end of the subsequent sheet P2 in the conveying direction passes the gap between the second driving roller 30 and the second pinch roller 31.

Figure 7:
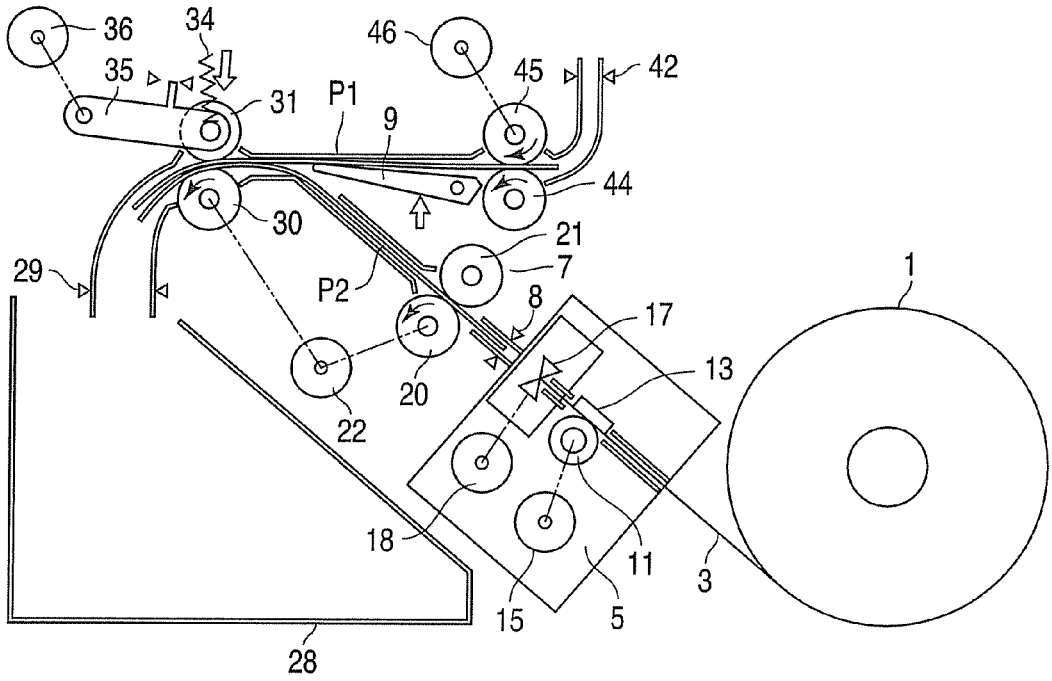
FIG. 7 is a view illustrating a state that the preceding sheet and the subsequent sheet in FIG. 6 are conveyed in the reverse-to-sheet-discharge direction.

The trailing end of this subsequent sheet P2 in the conveying direction is detected by the sending-out detecting sensor 8. Based on a configuration that the distance from the trailing end to the second driving roller 30 becomes equal to that from the front end of the preceding sheet P1 awaiting at the awaiting position 49 to the second driving roller 30, the second pinch roller 31 is lowered as illustrated in FIG. 7 so as to push the preceding sheet P1 and the subsequent sheet P2 onto the second driving roller 30, and further the second driving roller 30 is reversely rotated.

Figure 8:
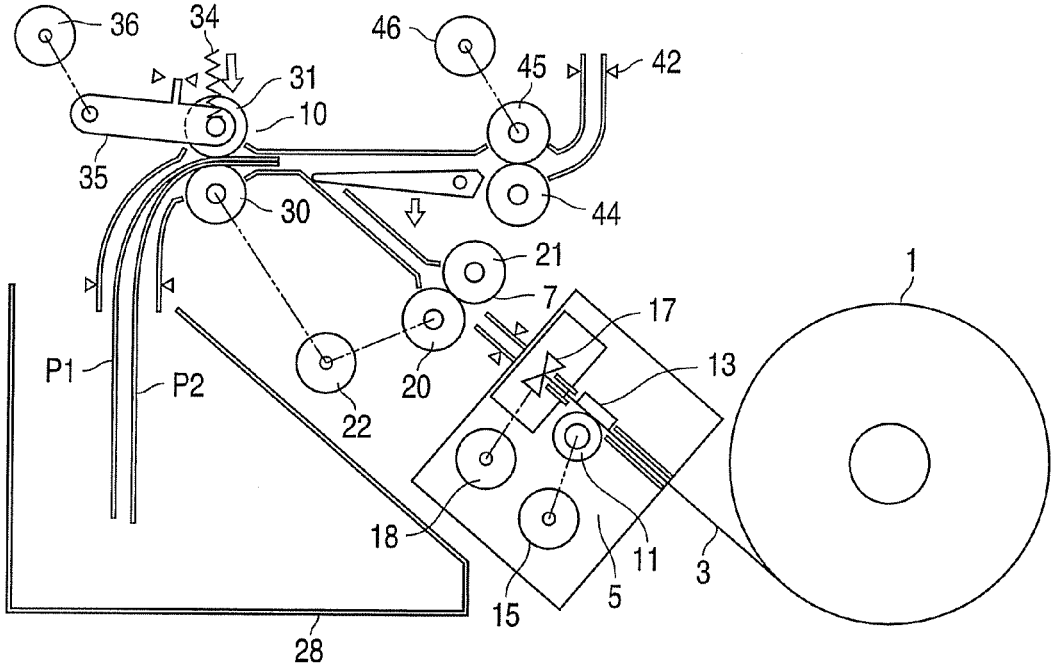
FIG. 8 is a view illustrating a state that the preceding sheet and the subsequent sheet in FIG. 7 are further conveyed in the reverse-to-sheet-discharge direction and then stopped with the trailing ends thereof being made even.

In this way, the preceding sheet P1 and the subsequent sheet P2 are conveyed in the reverse-to-sheet-discharge direction, so that the sheets P1 and P2 are put onto each other in the state that their trailing ends in the conveying direction are made even as illustrated in FIG. 8. In this state, the sheets P1 and P2 are stopped. At this time, the front end sides of the preceding sheet P1 and the subsequent sheet P2 in the conveying direction are inserted in the collecting shed 28, which is sufficiently wide. Thus, even when the length of the preceding sheet P1 is different from that of the subsequent sheet P2, the sheets can be put onto each other in the similar manner.

Figure 9:
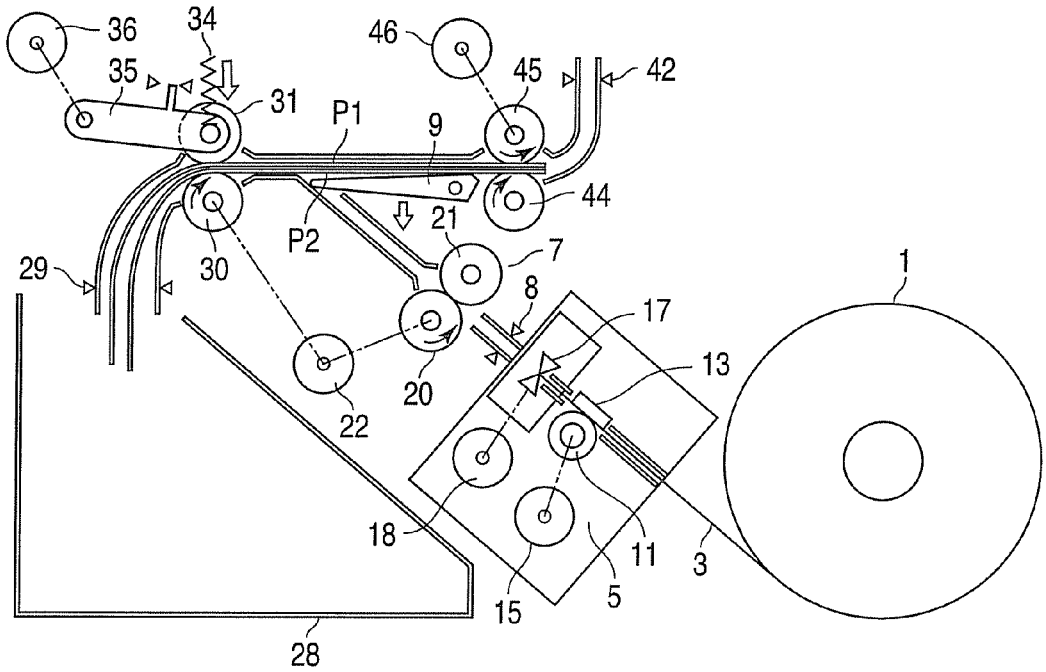
FIG. 9 is a view illustrating a state that the preceding sheet and the subsequent sheet in FIG. 8 are conveyed in the sheet-discharging direction.

After the preceding sheet P1 and the subsequent sheet P2 are stopped in the state that their trailing ends in the conveying direction are made even, the second driving roller 30 and the third driving roller 45 are rotated forward to convey the preceding sheets P1 and the subsequent sheet P2 as illustrated in FIG. 9. The sheets P1 and P2 are then stopped at a position where their front ends in the conveying direction pass the third driving roller 45. Furthermore, when subsequent sheets are continuously discharged, the above-mentioned operation is repeated.

Figure 10:
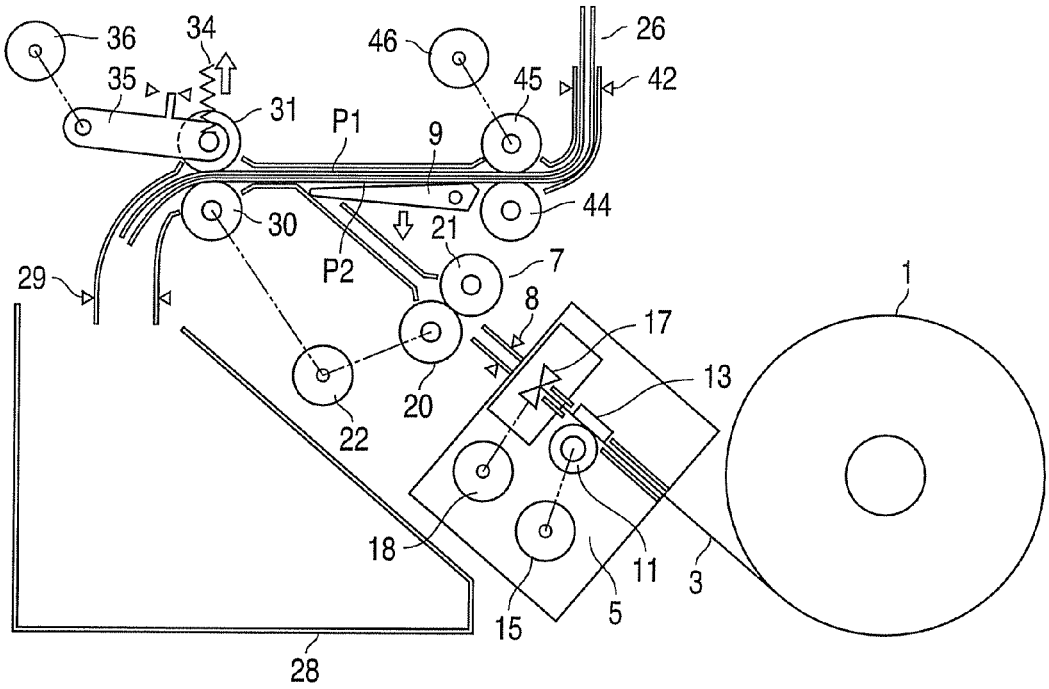
FIG. 10 is a view illustrating a state that the preceding sheet and the subsequent sheet in FIG. 9 are discharged into a discharging unit.

After all the sheets P1 and P2 are put onto each other, the second driving roller 30 and the third driving rollers 45 are rotated forward. In this way, as illustrated in FIG. 10, the sheets P1 and P2 are conveyed in the sheet-discharging direction, and the front ends thereof in the conveying direction are sent out into the discharging unit 26. The user pulls out the sent-out sheets P1 and P2.

After the sheets P1 and P2 are sent out, in order that the user can pull out the sheets P1 and P2 easily, the second pinch roller 31 is separated from the second driving roller 30 and further the supply of a holding current for the motor 46 for driving the third driving roller 45 is stopped.

Instead of stopping the supply of the holding current for the motor 46 for driving the third driving roller 45, the third driving roller 45 may have, in its driving gear series, a torque limit type of clutch.

Figure 11:
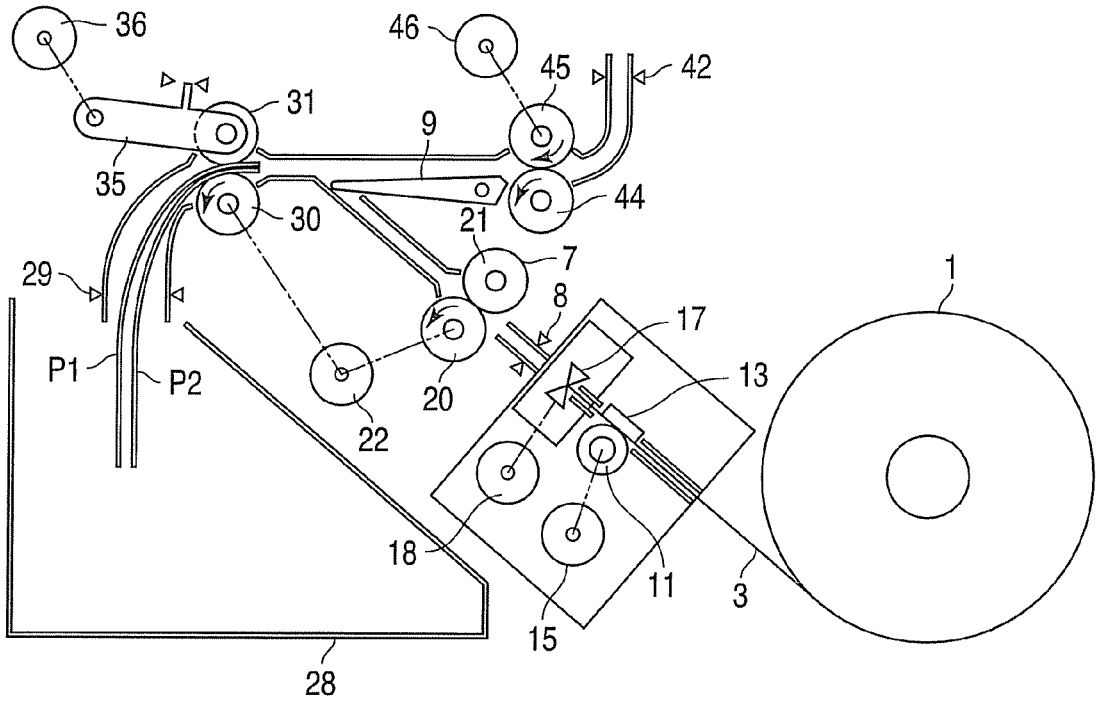
FIG. 11 is a view illustrating a state that the preceding sheet and the subsequent sheet in FIG. 10 are collected in a collecting unit.

In the meantime, when a predetermined period elapses in the state that the sheets P1 and P2 sent out in the discharging unit 26 as described above are detected by the discharge detecting sensor 42, it is determined that the sheets P1 and P2 are not pulled out by the user. As illustrated in FIG. 11, based on the determination, the third driving roller 45 and the second driving roller 30 are reversely rotated so that all the sheets P1 and P2 are collected into the collecting shed 28.

After the trailing ends of the sheets P1 and P2 in the conveying direction pass the second driving roller 30 in the collection, no conveying force can be given to the sheets P1 and P2. However, the front end sides of the sheets P1 and P2 in the conveying direction are already inserted in the collecting shed 28; therefore, the sheets P1 and P2 are naturally dropped into the collecting shed 28 by their own weights. In this way, the sheets P1 and P2 are collected.

When the sheets P1 and P2 are collected so that the collection detecting sensor 29 comes not to detect the sheet P1 nor P2, the printer stands by in the state that the second pinch roller 31 is separated from the driving roller 30 as illustrated in FIG. 3 in order to prepare for the discharge of the next sheet.

As described above, in this embodiment, the trailing end of the subsequent sheet P2 in the conveying direction is detected by the sending-out detecting sensor 8, and then based on the configuration that the distance from the trailing end to the second driving roller 30 becomes equal to that from the front end of the preceding sheet P1 awaiting at the awaiting position 49 to the second driving roller 30, the preceding sheet P1 and the subsequent sheet P2 are conveyed in the reverse-to-sheet-discharge direction while sandwiched. In this way, the sheets P1 and P2 are put onto each other. Accordingly, even when the preceding sheet P1 and the subsequent sheet P2 are different from each other in length in the conveying direction, the sheets P1 and P2 can be put onto each other in the state that their front ends in the sheet-discharging direction are made even. The sheets P1 and P2 can then be discharged as they are. Thus, the user can easily pull out the sheets P1 and P2.

The printer also has an advantage that the structure thereof can be made compact since the collecting shed 28 is used as a part of the conveying path for the preceding sheet P1 and the subsequent sheet P2.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printer comprising:

a printing device which prints information on a first sheet conveyed along a main conveying path, and a second sheet conveyed subsequently to the first sheet;

a conveying device arranged on the conveying-out side of the main conveying path, and having a pair of conveying rollers which can be freely contacted with each other and separated from each other, which sandwich a front end side of the first sheet sent out from the main conveying path to convey the first sheet in a first direction, and which convey, after a trailing end side thereof passes the main conveying path, the first sheet into a second direction reverse to the first direction in the state that the trailing end side is directed ahead, so as to cause the first sheet to await at an awaiting position;

a controlling device which controls in such a manner that the pair of conveying rollers are separated from each other to permit a front end side of the second sheet sent out from the main conveying path to be introduced into a gap between the conveying rollers, and based on a configuration that the distance from a trailing end side of the second sheet in a conveying direction to the pair of conveying rollers becomes equal to the distance from the trailing end side of the first sheet caused to await at the awaiting position to the pair of conveying rollers, the first and second sheets are sandwiched by the pair of conveying rollers so as to be conveyed in the first direction and be put onto each other, and subsequently the first and second sheets are conveyed to be sent out in the second direction; and a discharging unit which discharges the first and second sheets sent out in the state that the sheets are put onto each other.

2. The printer according to claim 1, wherein the pair of conveying rollers are separated from each other after the first and second sheets are discharged into the discharging unit.

3. The printer according to claim 1, wherein when the first and second sheets discharged into the discharging unit are stood still for a predetermined period, the first and second sheets are sandwiched by the pair of conveying rollers so as to be conveyed into the first direction and collected into a collecting shed.

4. The printer according to claim 1, wherein the main conveying path is opened and closed on the conveying-out side thereof by means of a flapper.

5. The printer according to claim 1, wherein the conveying-out side of the main conveying path is connected to the discharging unit through a conveying path for discharging.

6. The printer according to claim 3, wherein the conveying-out side of the main conveying path is connected to the collecting shed through a conveying path for collecting.

7. The printer according to claim 5, wherein the awaiting position is located in the conveying path for discharging.

8. The printer according to claim 3, wherein after the first and second sheets conveyed toward the collecting shed are sent out from the pair of conveying rollers, the sheets are naturally dropped by their own weights so as to be collected.

9. The printer according to claim 6, wherein the conveying path for collecting and the collecting shed function also as a conveying path when the first and second sheets are sandwiched and conveyed in the first direction by the pair of conveying rollers.

10. The printer according to claim 1, wherein the size of the first sheet is different from that of the second sheet.

11. The printer according to claim 1, wherein the pair of conveying rollers are a driving roller which rotates forward and backward, and a pinch roller which is contacted to the driving roller and separated from the driving roller.

* * * * *